US010234792B2

(12) United States Patent
Eto

(10) Patent No.: US 10,234,792 B2
(45) Date of Patent: Mar. 19, 2019

(54) DEVELOPER CONTAINER AND IMAGE FORMING DEVICE EQUIPPED WITH SAME

(71) Applicant: KYOCERA Document Solutions Inc., Osaka-shi (JP)

(72) Inventor: Daisuke Eto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/567,457

(22) PCT Filed: Jul. 11, 2016

(86) PCT No.: PCT/JP2016/070482

§ 371 (c)(1),
(2) Date: Oct. 18, 2017

(87) PCT Pub. No.: WO2017/033599

PCT Pub. Date: Mar. 2, 2017

(65) Prior Publication Data

US 2018/0052408 A1 Feb. 22, 2018

(30) Foreign Application Priority Data

Aug. 26, 2015 (JP) ..... 2015-166872

(51) Int. Cl.
*G03G 15/08* (2006.01)
*G03G 21/16* (2006.01)

(52) U.S. Cl.
CPC ..... *G03G 15/0889* (2013.01); *G03G 15/08* (2013.01); *G03G 15/0875* (2013.01); (Continued)

(58) Field of Classification Search
CPC ..... G03G 15/0889; G03G 15/08; G03G 15/0875; G03G 15/0881; G03G 21/16; G03G 2215/085
See application file for complete search history.

(56) References Cited

U.S. PATENT DOCUMENTS

2012/0057886 A1 3/2012 Nozawa
2013/0136489 A1 5/2013 Yamaguchi et al.
2014/0321883 A1* 10/2014 Nakazawa ..... G03G 21/1676 399/119

FOREIGN PATENT DOCUMENTS

EP 0744670 A1 11/1996
EP 2426560 A1 3/2012
(Continued)

OTHER PUBLICATIONS

European Search Report dated May 8, 2018.
Japanese Office Action dated May 29, 2018.
International Search Report dated Aug. 16, 2016.

*Primary Examiner* — Ryan D Walsh
(74) *Attorney, Agent, or Firm* — Gerald E. Hespos; Michael J. Porco; Matthew T. Hespos

(57) ABSTRACT

A developer storage container (30) includes: a container body (31); a lid (32); a stirring member (34); and an input gear (36). The container body includes: a bottom portion (310); an opening (31P) extending in a longitudinal direction thereof; a first sidewall (31R) and a second sidewall (31L); and a storage space (30S) for storing developer therein. The second sidewall includes a bearing portion (312) disposed to face the storage space. The first sidewall includes: a shaft hole (313S) communicating between an outside of the container body and the storage space; and a support portion (313T) supporting a distal end of a coupling (342) of the stirring member from therebelow to prevent the stirring member from falling onto the bottom portion, in a state in which a distal pivot portion (341) of the stirring member is inserted into the bearing portion, and the coupling is disposed facing the shaft hole.

6 Claims, 13 Drawing Sheets

(52) U.S. Cl.
CPC ..... *G03G 15/0881* (2013.01); *G03G 21/16* (2013.01); *G03G 2215/085* (2013.01)

(56) References Cited

FOREIGN PATENT DOCUMENTS

| | | | |
|---|---|---|---|
| JP | 2004-302337 | | 10/2004 |
| JP | 2008233225 | A | 10/2008 |
| JP | 2010-96827 | | 4/2010 |
| JP | 2013114037 | A | 6/2013 |
| JP | 2014-71422 | | 4/2014 |

* cited by examiner

DEVELOPER CONTAINER AND IMAGE FORMING DEVICE EQUIPPED WITH SAME

TECHNICAL FIELD

The present invention relates to a developer storage container for storing developer thereinside, and an image forming apparatus equipped with the developer storage container.

BACKGROUND ART

Heretofore, as a developer storage container for storing developer thereinside, there has been known a toner container as described in JP 2010-96827A. This toner container includes a container body having a toner discharge port opened therein, a lid, a stirring paddle, and a conveyance screw. The lid is welded to an upper end of the container body to thereby form a storage space for toner therein. The stirring paddle is rotated to stir toner in the storage space. Concurrently, the conveyance screw is rotated to convey toner toward the toner discharge port.

SUMMARY OF INVENTION

In the toner container described in Patent Literature 1, before welding the lid to the container body, an input gear unit for transferring a rotational drive force to the stirring paddle is coupled to the stirring paddle from outside the container body. In this case, there is a problem that a measure for preventing the input gear unit from hindering the lid welding operation imposes restrictions on a shape and a size of the input gear unit.

It is an object of the present invention to provide a developer storage container configured to inhibit a situation where an input gear unit engageable with a stirring member restricts a lid fixing operation, and an image forming apparatus equipped with the developer storage container.

According to one aspect of the present invention, there is provided a developer storage container which includes a container body, a lid, a stirring member, and an input gear unit. The container body includes: a bottom portion; an opening extending in a longitudinal direction thereof; a first sidewall and a second sidewall arranged, respectively, at longitudinally opposite ends thereof; and a storage space disposed between the first sidewall and the second sidewall to store developer therein. The lid is fixed to the container body in such a manner as to close the opening. The stirring member is disposed in the storage space at a position above and away from the bottom portion by a given distance, and rotatably supported by the first sidewall and the second sidewall, wherein the stirring member is operable to stir the developer stored in the storage space. The input gear unit is disposed outside the first sidewall of the container body, and includes an engagement portion engageable with the stirring member, wherein the input gear unit is operable to input a rotational drive force into the stirring member. In this developer storage container, the stirring member includes a coupling disposed at one of longitudinally opposite ends thereof and engageable with the engagement portion of the input gear unit, and a distal pivot portion disposed at the other one of the longitudinally opposite ends. The second sidewall includes a bearing portion disposed to face the storage space. The first sidewall includes: a shaft hole which communicates penetratingly extends between an outside of the container body and the storage space; and a support portion which supports the coupling from therebelow to prevent the stirring member from falling onto the bottom portion, in a state in which the distal pivot portion is inserted into the bearing portion, and the coupling is disposed in opposed relation to the shaft hole.

According to another aspect of the present invention, there is a provided an image forming apparatus which includes: the above developer storage container; an image supporting body having a surface on which an electrostatic latent image is to be formed and a developer image is to be supported; and a transfer unit which transfers the developer image from the image supporting body to a sheet.

The present invention can provide a developer storage container configured to inhibit the situation where the input gear unit engageable with the stirring member restricts a lid fixing operation, and an image forming apparatus equipped with the developer storage container.

DESCRIPTION OF EMBODIMENTS

Figure 1:
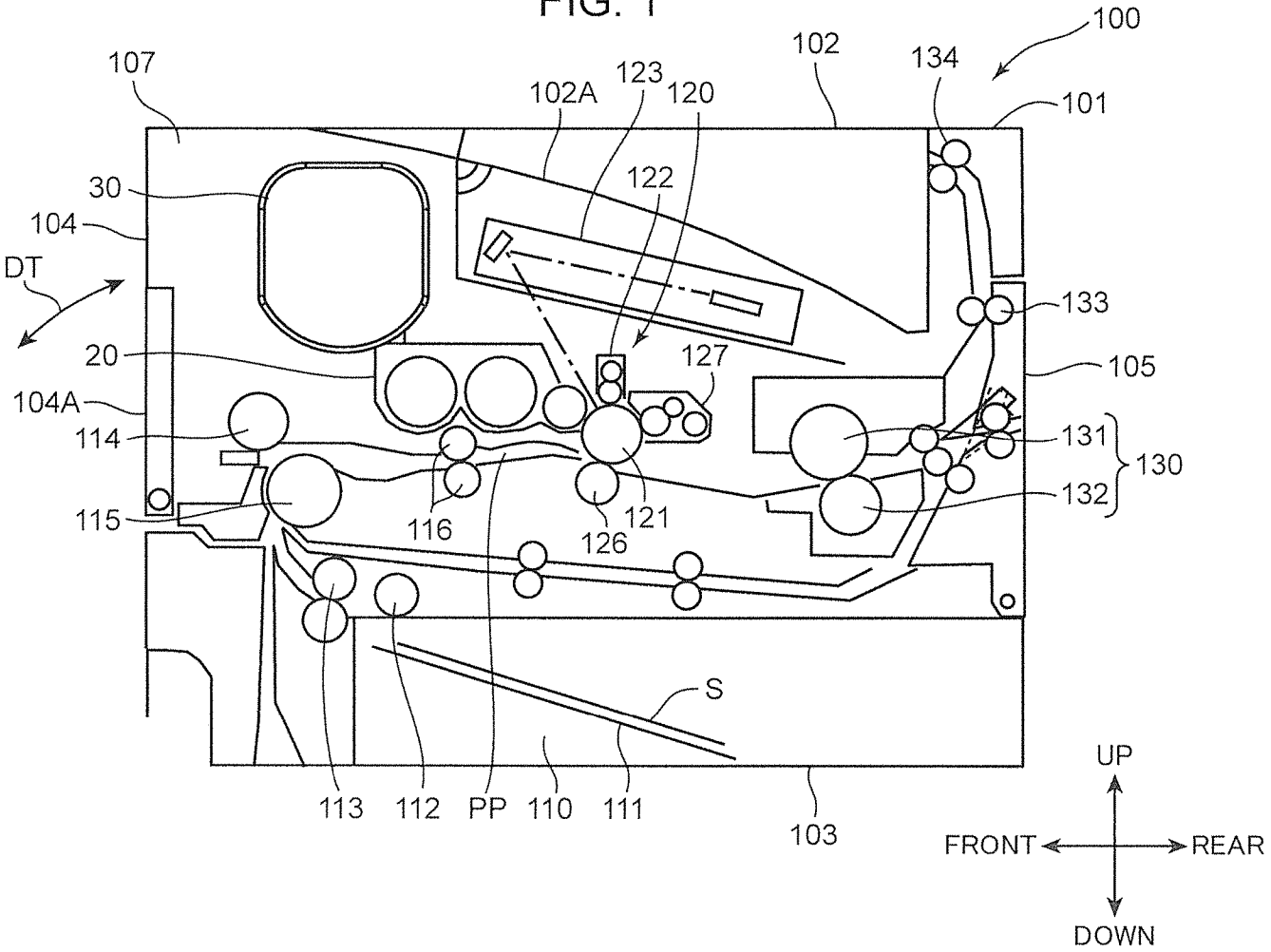
FIG. 1 is a sectional view showing an inside of an image forming apparatus according to one embodiment of the present invention.

With reference to the drawings, the present invention will be described based on one embodiment thereof. FIG. 1 is a sectional view schematically showing an internal structure of a printer 100 (image forming apparatus) according to one embodiment of the present invention. The printer 100 shown in FIG. 1 is a so-called monochrome printing machine. However, in another embodiment, the image forming apparatus may be a color printer, a facsimile machine, a complex machine having functions thereof, or any other type of apparatus for forming a toner image on a sheet. Further, the term used in the following description to express a direction, such as "up (upward)", "down (downward)", "front (forward)", "rear (rearward)", "left (leftward)" or "right (rightward)", is merely intended to make descriptions clear, but not meant to limit the principle of the image forming apparatus.

The printer 100 includes a printer body 101 which houses various devices for forming an image on a sheet S. The printer body 101 includes: an upper wall 102 defining an upper surface of the printer body 101; a bottom wall 103 defining a bottom surface of the printer body 101; a rear wall 105 provided between the upper wall 102 and the bottom wall 103; and a front wall 104 located forward of the rear wall 105. The printer body 101 defines therein an internal space 107 in which various devices are arranged. In the internal space 107 of the printer body 101, a sheet conveyance path PP is provided as a means to convey a sheet S in a sheet conveyance direction.

A central region of the upper wall 102 is formed as a sheet discharge section 102A. The sheet discharge section 102A is formed to have an inclined surface extending rearwardly and obliquely downwardly from a front portion of the upper wall 102. The sheet discharge section 102A is disposed to allow a sheet S having an image formed thereon by an aftermentioned image forming section 120 to be ejected thereinto. The front wall 104 is provided with a manual feed tray 104A in a central region thereof in an upward-downward direction. The manual feed tray 104A is swingable upwardly and downwardly, about a pivot point at a lower end thereof (arrowed line DT in FIG. 1).

Referring to FIG. 1, the printer 100 further includes a cassette 110, a pickup roller 112, a first sheet feeding roller 113, a second sheet feeding roller 114, a conveyance roller 115, a registration roller pair 116, an image forming section 120, and a fixing device 130.

The cassette 110 stores therein a plurality of sheets S. The cassette 110 has a lift plate 111. The lift plate 111 is inclined to push up leading edges of the sheets S. The cassette 110 is configured to be drawable forwardly with respect to the printer body 101.

The pickup roller 112 is disposed just above the leading edge of an uppermost one of the sheets S pushed up by the lift plate 111. Upon rotation of the pickup roller 112, the uppermost sheet S is picked up from the cassette 110.

The first sheet feeding roller 113 is disposed downstream of the pickup roller 112, and is operable to feed out the sheet S toward a downstream side. The second sheet feeding roller 114 is disposed inward (rearward) of the pivot point of the manual feed tray 104A and is operable to pull a sheet S on the manual feed tray 104A inside the printer body 101.

The conveyance roller 115 is disposed downstream of the first sheet feeding roller 113 and the second sheet feeding roller 114 (hereinafter referred to simply as "downward") in the sheet conveyance direction (hereinafter referred to simply as "conveyance direction"). The conveyance roller 115 is operable to further convey, toward the downstream side, the sheet S fed out from the first sheet feeding roller 113 and the second sheet feeding roller 114.

The registration roller pair 116 has a function of correcting oblique conveyance of the sheet S. Through this correction, a position of an image to be formed on the sheet S is adjusted. Specifically, the registration roller pair 116 is operable to feed the sheet S to the image forming section 120 in conformity to a timing of image formation by the image forming section 120.

The image forming section 120 includes a photosensitive drum 121 (image supporting body), an electrostatic charger 122, an exposure device 123, a development device 20, a toner container 30 (developer storage container), a transfer roller 126 (transfer unit), and a cleaning device 127.

The photosensitive drum 121 has a cylindrical shape. The photosensitive drum 121 has an outer peripheral surface on which an electrostatic latent image is to be formed and a toner image (developer image) corresponding to the electrostatic latent image is to be supported. The electrostatic charger 122 is operable, upon application of a given voltage thereto, to electrostatically charge the outer peripheral surface of the photosensitive drum 121 approximately uniformly.

The exposure device 123 is operable to emit a laser beam to the outer peripheral surface of the photosensitive drum 121 electrostatically charged by the electrostatic charger 122. The laser beam is emitted according to image data output from an external device (not shown) such as a personal computer communicatably connected to the printer 100. As a result, an electrostatic latent image corresponding to the image data is formed on the outer peripheral surface of the photosensitive drum 121.

The development device 20 is operable to supply toner to the outer peripheral surface of the photosensitive drum 121 having the electrostatic latent image formed thereon. The toner container 30 is configured to supplementarily supply the toner to the development device 20. The toner container 30 is demountably mounted to the printer body 101. When toner is supplied from the development device 20 to the photosensitive drum 121, the electrostatic latent image formed on the outer peripheral surface of the photosensitive drum 121 is developed (visualized). As a result, a toner image (developer image) is formed on the outer peripheral surface of the photosensitive drum 121.

The transfer roller 126 is disposed below and in opposed relation to the photosensitive drum 121 across the sheet conveyance path PP. The transfer roller 126 forms a transfer nip portion in cooperation with the photosensitive drum 121, to enable the toner image to be transferred onto the sheet S.

The cleaning device 127 is operable to remove toner remaining on the outer peripheral surface of the photosensitive drum 121 after the toner image is transferred to the sheet S.

The fixing device 130 is disposed downstream of the image forming section 120 in the conveyance direction, and is operable to fix the toner image on the sheet S. The fixing device 130 includes a heating roller 131 for melting toner on the sheet S, and a pressure roller 132 for bringing the sheet S into close contact with the heating roller 131.

The printer 100 further includes a conveyance roller pair 133 disposed downstream of the fixing device 130, and an discharge roller pair 134 disposed downstream of the conveyance roller pair 133. The sheet S is conveyed upwardly by the conveyance roller pair 133, and discharged from the printer body 101 by the discharge roller pair 134. The sheets S sequentially discharged from the printer body 101 are stacked on the sheet discharge section 102A.

Figure 2:
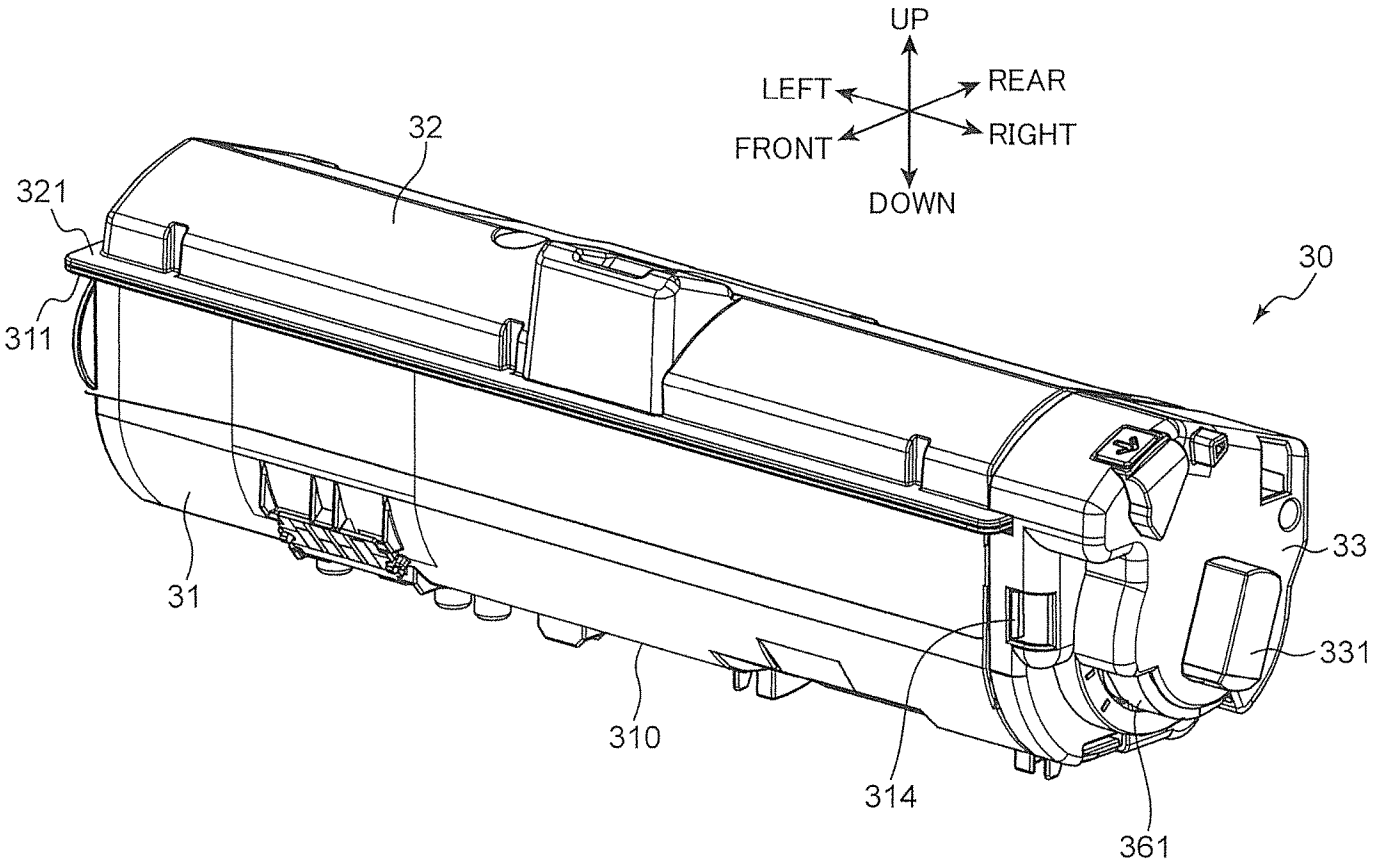
FIG. 2 is a perspective view showing a development storage container according to one embodiment of the present invention.
Figure 3:
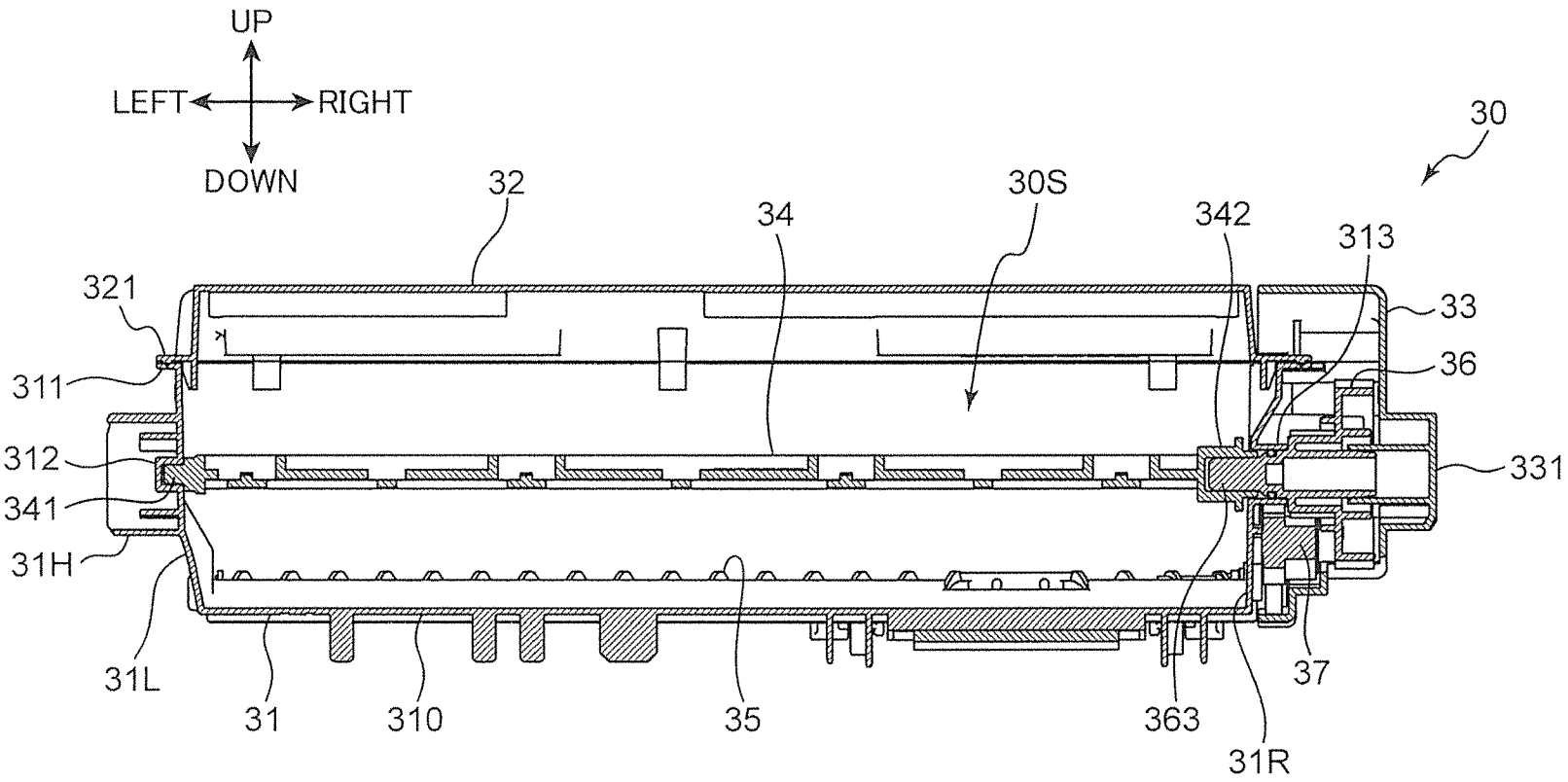
FIG. 3 is a sectional view showing the development storage container according to this embodiment.
Figure 4:
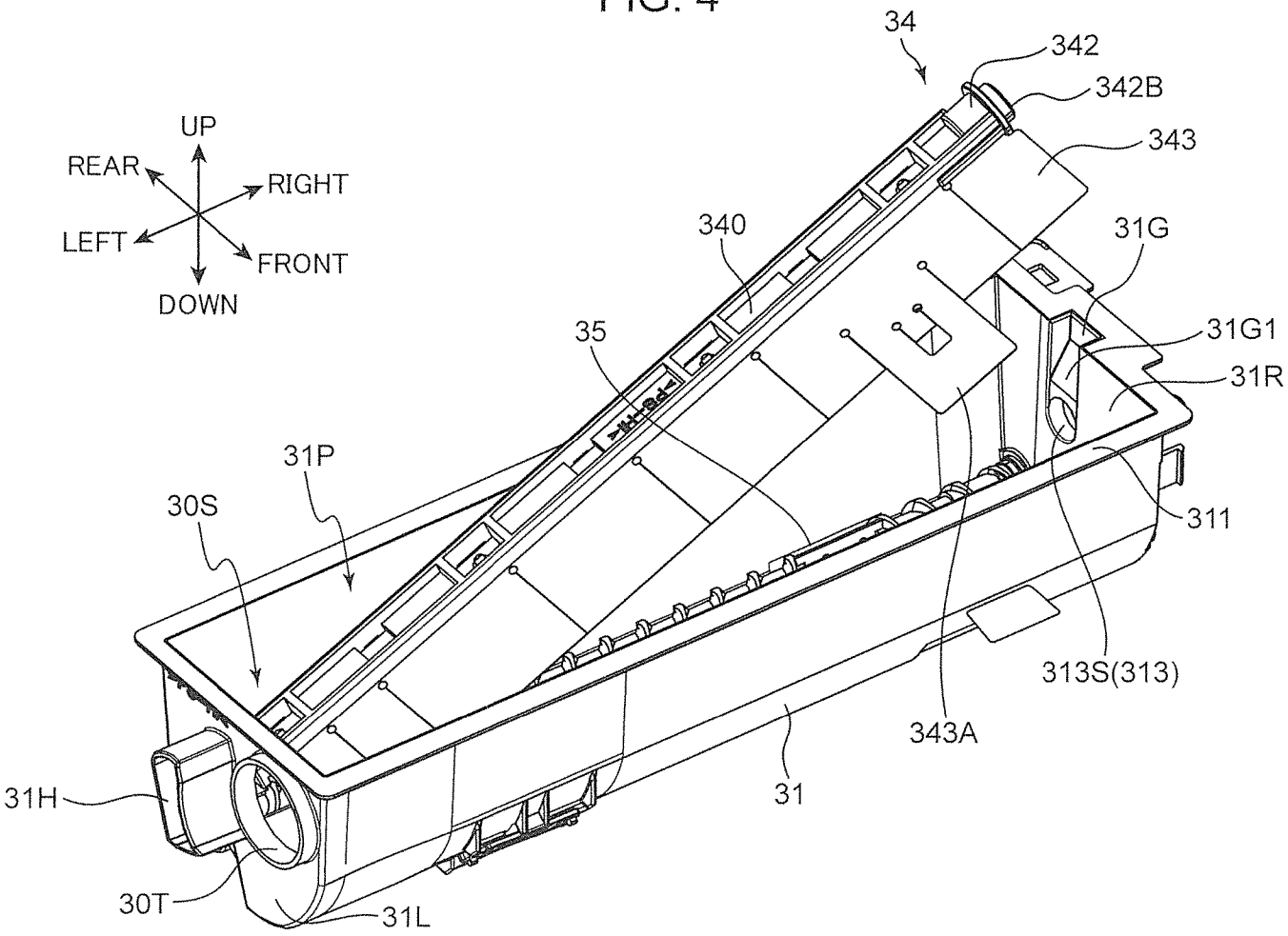
FIG. 4 is a perspective view showing a state when a stirring member is being attached to a container body, in the development storage container according to this embodiment.
Figure 5:
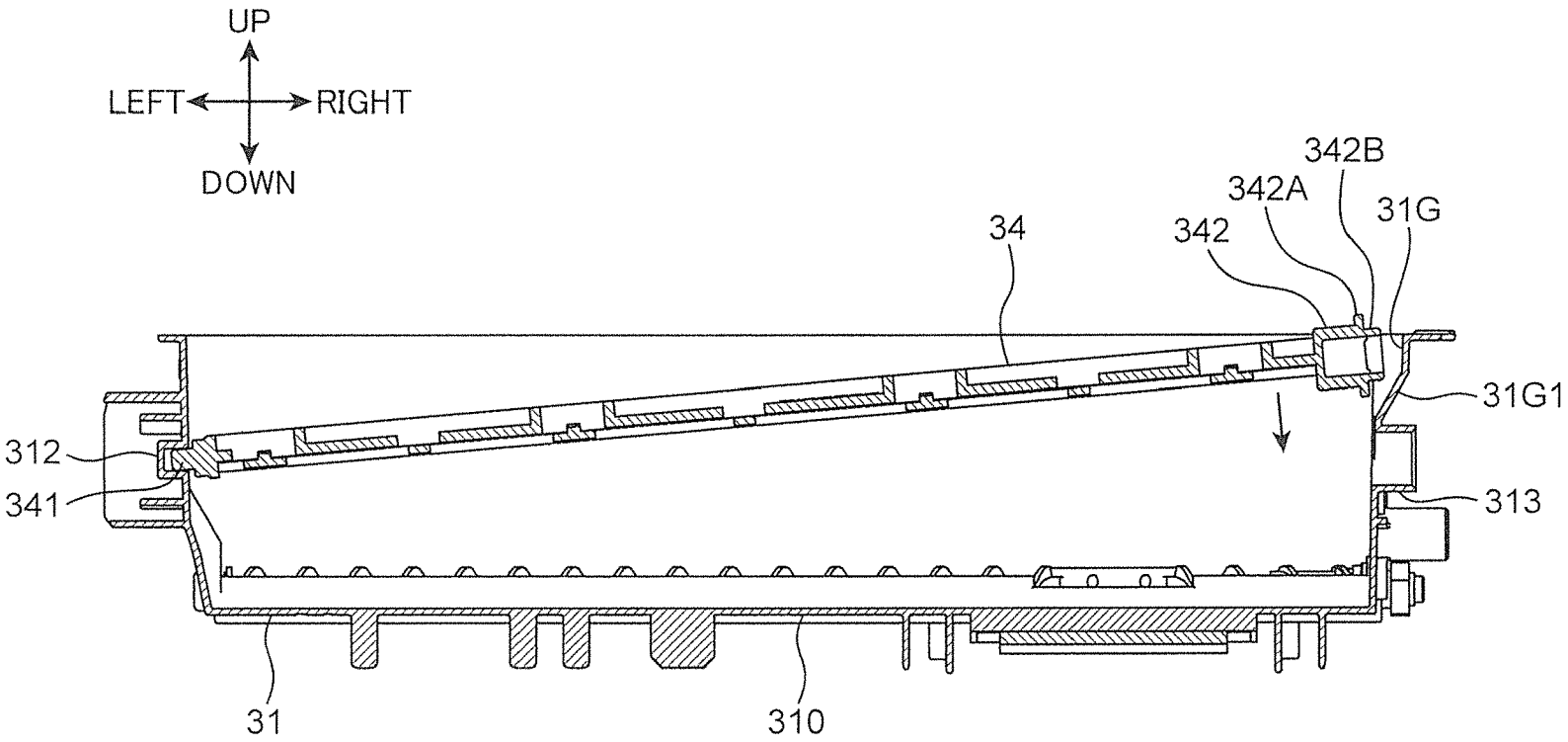
FIG. 5 is a sectional view showing the state when the stirring member is being attached to the container body, in the development storage container according to this embodiment.
Figure 6:
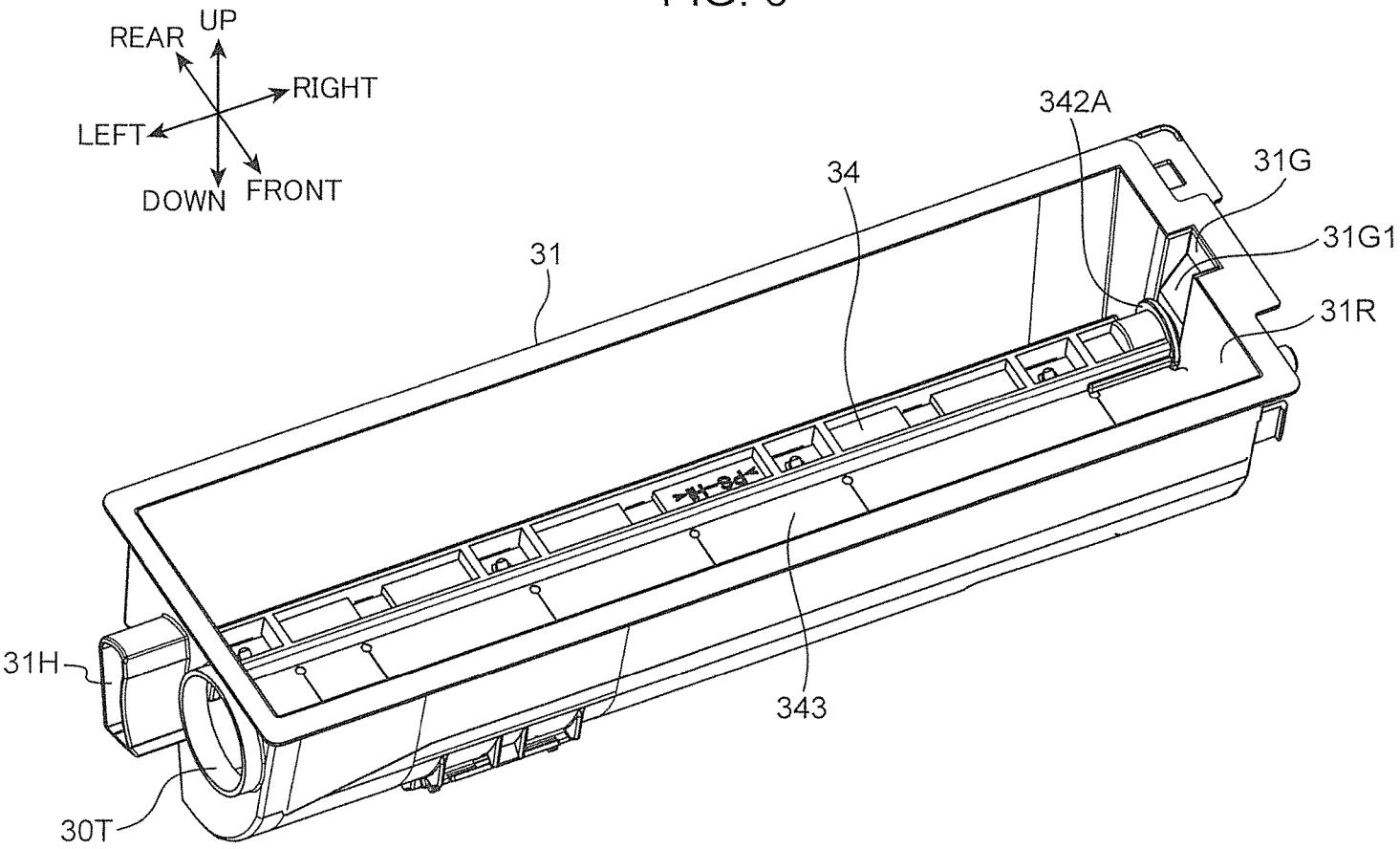
FIG. 6 is a perspective view showing a state in which the stirring member is attached to the container body, in the development storage container according to this embodiment.
Figure 7:
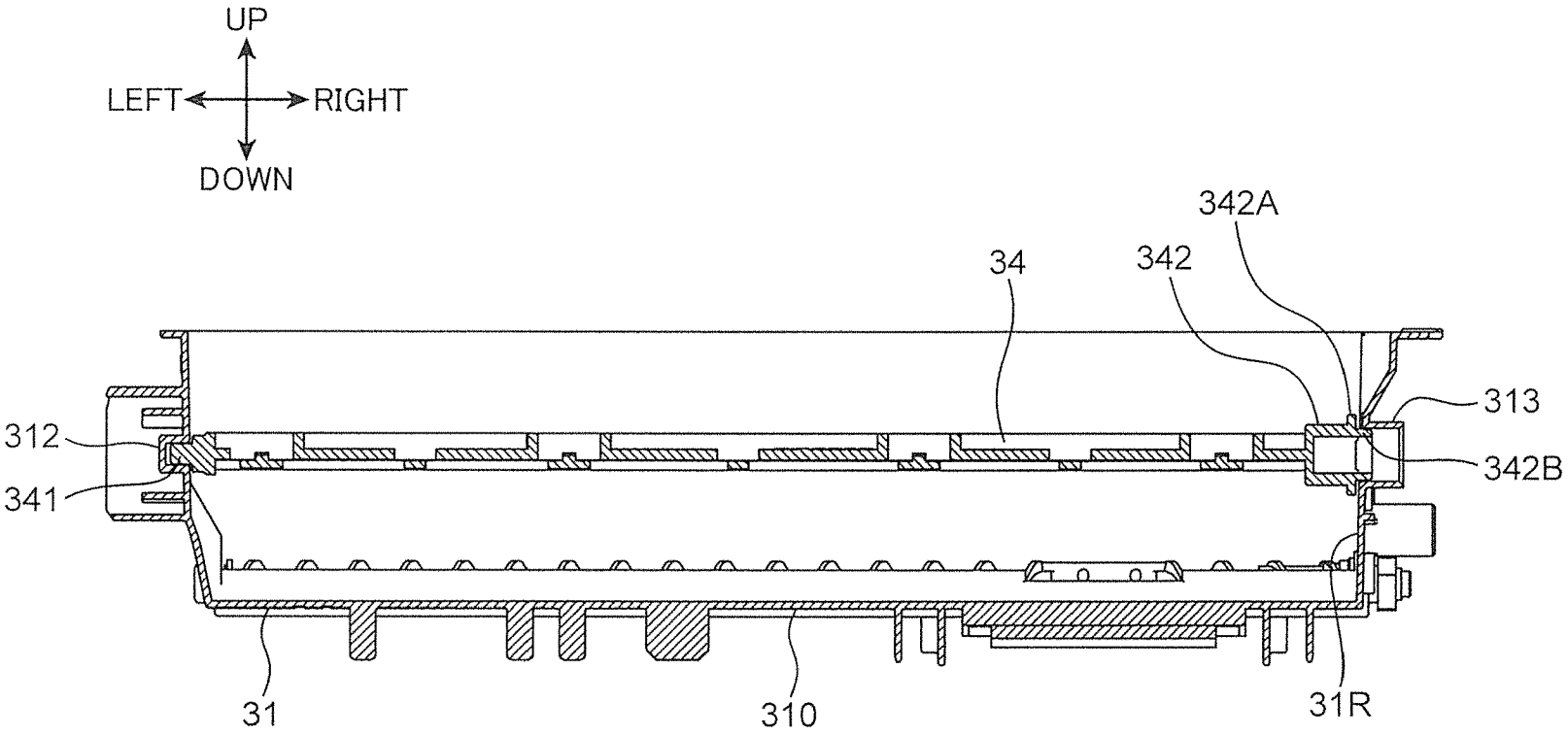
FIG. 7 is a sectional view showing the state in which the stirring member is attached to the container body, in the development storage container according to this embodiment.
Figure 8:
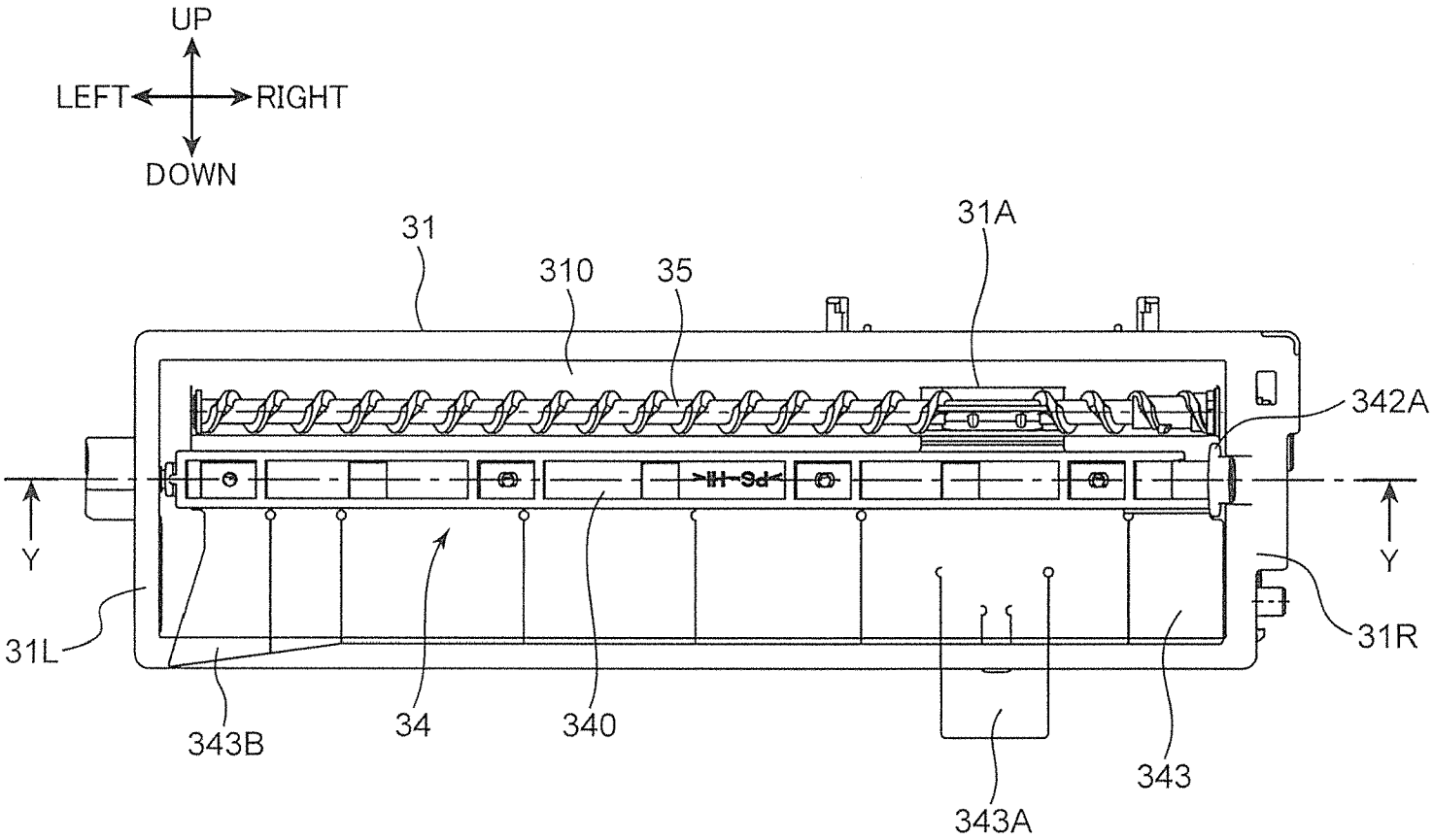
FIG. 8 is a top plan view showing the state in which the stirring member is attached to the container body, in the development storage container according to this embodiment.
Figure 9:
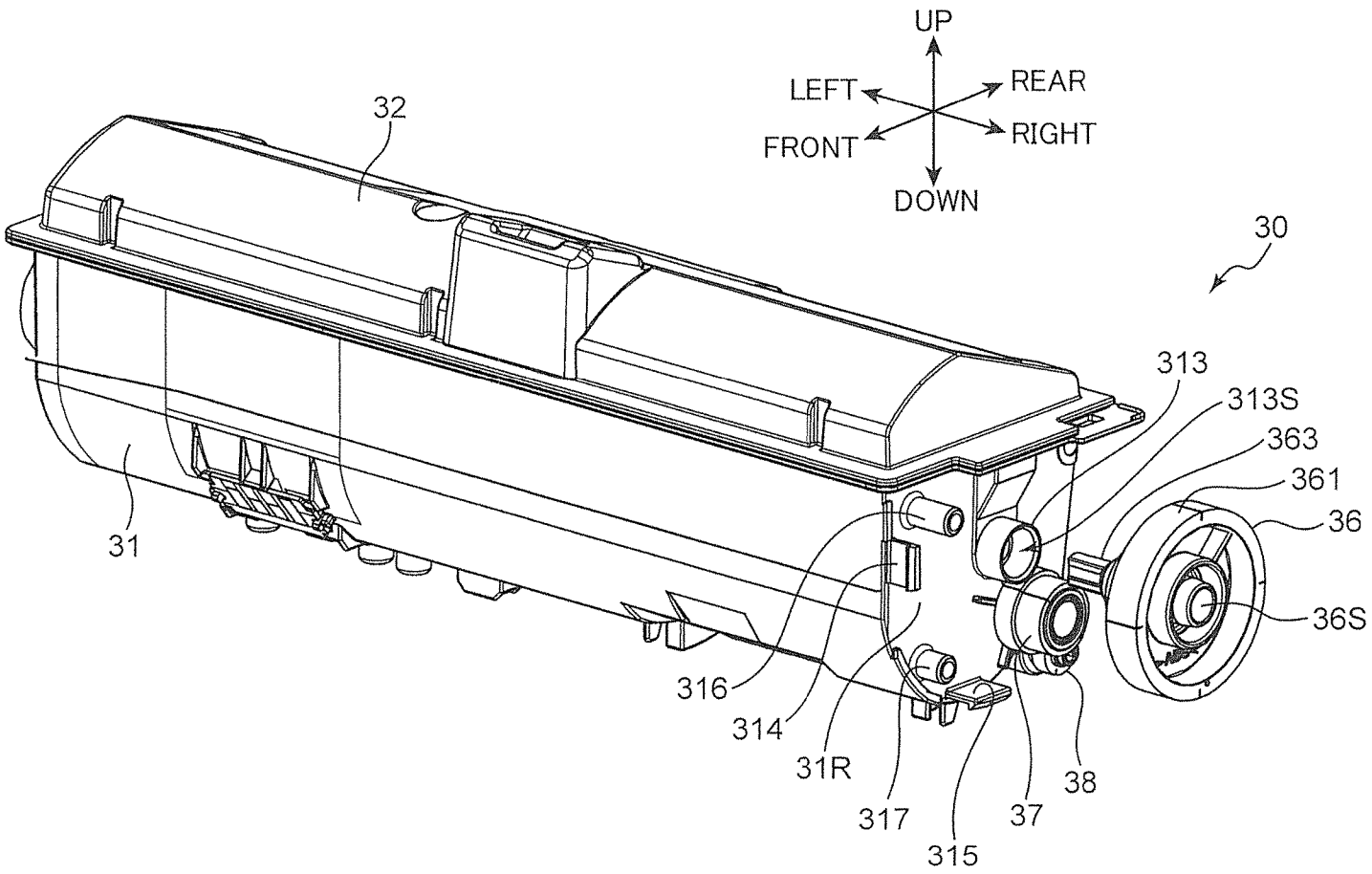
FIG. 9 is a sectional view showing a state when an input gear unit is being attached to the container body, in the development storage container according to this embodiment.
Figure 10:
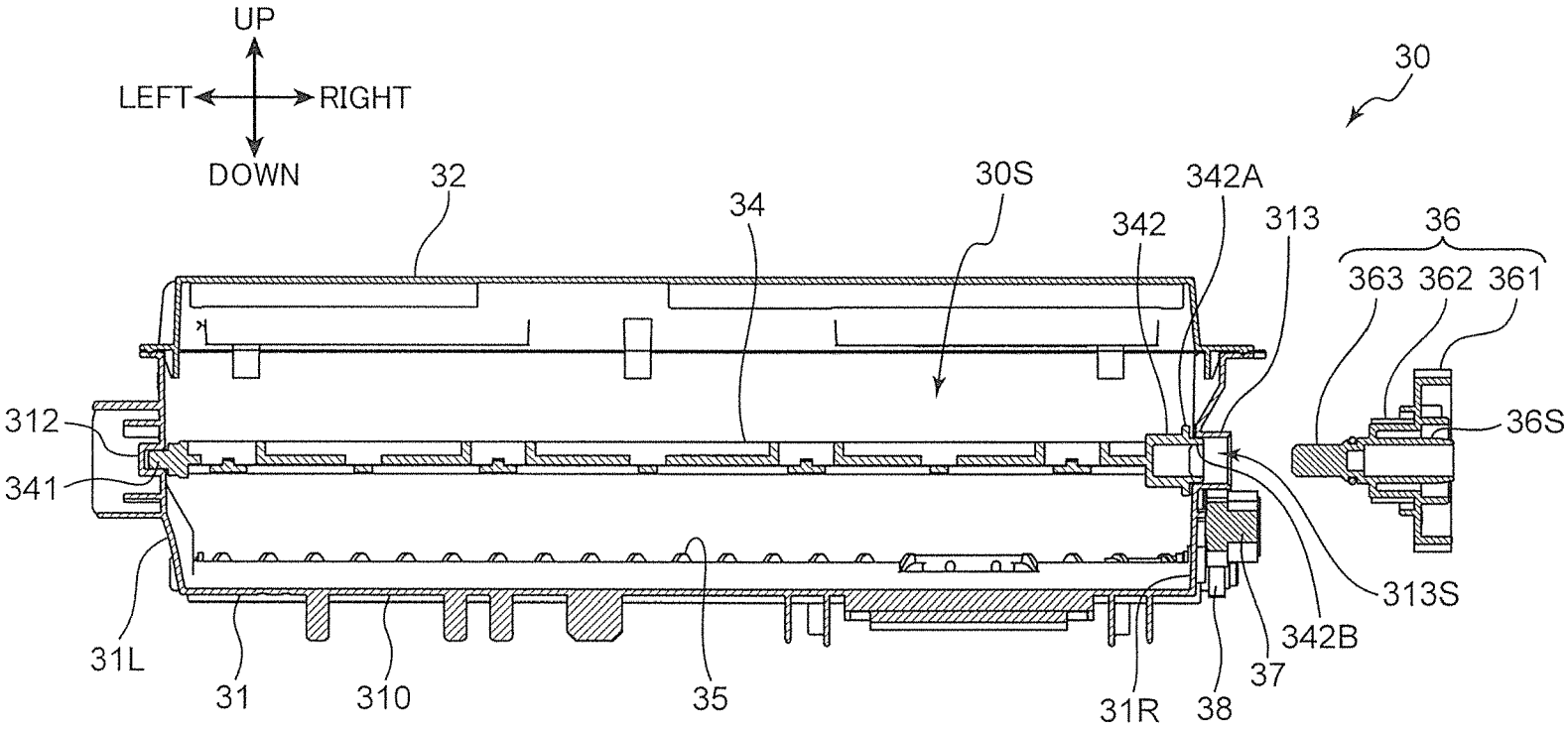
FIG. 10 is a sectional view showing the state when the input gear unit is being attached to the container body, in the development storage container according to this embodiment.
Figure 11:
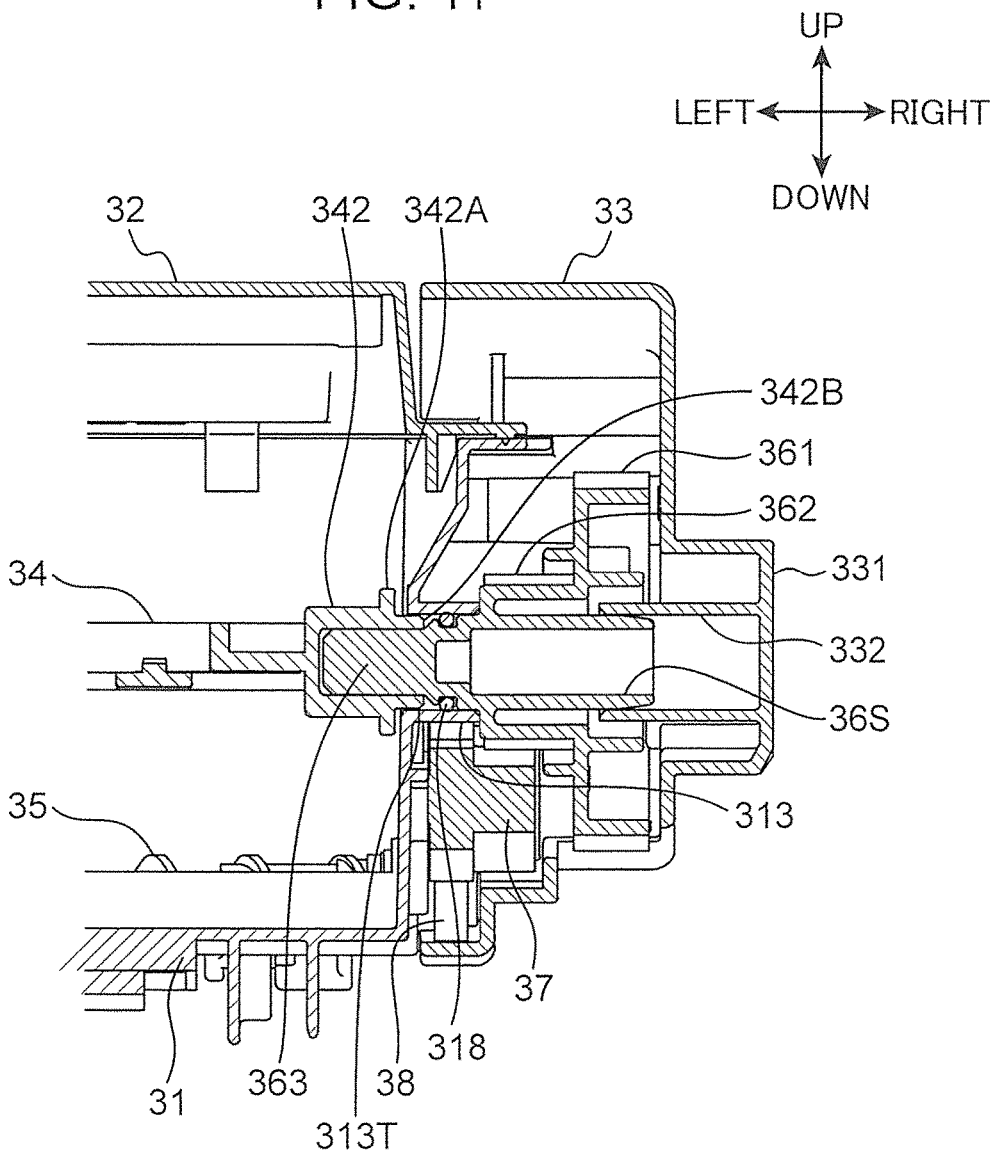
FIG. 11 is an enlarged sectional view showing a state in which the input gear unit is attached to the container body, in the development storage container according to this embodiment.

Next, with reference to FIGS. 2 to 11, the toner container 30 according to this embodiment will be described in detail. FIG. 2 and FIG. 3 are, respectively, a perspective view and a sectional view showing the toner container 30 according to this embodiment. FIG. 4 and FIG. 5 are, respectively, a perspective view and a sectional view showing a state when an aftermentioned stirring paddle 34 is being attached to an aftermentioned container body 31, in the toner container 30. FIG. 6, FIG. 7 and FIG. 8 are, respectively, a perspective view, a sectional view and a top plan view showing a state in which the aftermentioned stirring paddle is attached to the aftermentioned container body 31, in the toner container 30. FIG. 9 and FIG. 10 are, respectively, a perspective view and a sectional view showing a state when an aftermentioned input gear unit 36 is being attached to the aftermentioned container body 31, in the toner container 30. FIG. 11 is an enlarged sectional view showing a state in which the aftermentioned input gear unit 36 is attached to the aftermentioned container body 36. The sectional view in each of FIGS. 3, 5, 7, 10 and 11 corresponds to a sectional view taken along the line Y-Y in FIG. 8.

The toner container 30 stores toner (developer) thereinside. The toner container 30 includes a container body 31, a lid 32, a cover 33, a stirring paddle 34 (stirring member), a conveyance screw 35, an input gear unit 36, an idler gear 37, and a screw gear 38 (FIG. 10).

The container body 31 has a shape extending in a rightward-leftward direction (longitudinal direction). The container body 31 includes a bottom portion 310, an opening 31P (FIG. 4), a right side portion 31R (first sidewall), a left side portion 31L (second sidewall), a body flange 311 (FIGS. 2 and 3), a body bearing portion 312 (bearing portion) (FIG. 3), an open cylindrical portion 313 (cylindrical portion), a first claw portion 314 (FIG. 9), a second claw portion 315, a first stud 316, a second stud 317, and an O-ring 318 (FIG. 11).

The bottom portion 310 is a lower part of the container body 31. The opening 31P is a portion formed by opening a top portion of the container body 31 to extend long in the rightward-leftward direction. The right side portion 31R is a right sidewall of the container body 31. The left side portion 31L is a left sidewall of the container body 31. The right side portion 31R and the left side portion 31L are arranged, respectively, at longitudinally opposite ends of the container body 31. Further, the container body 31 internally defines a storage space 30S between the right and left side portions 31R, 31L. Toner is stored in the storage space 30S. The left side portion 31L is formed with a toner supplementing port 30T (FIG. 4) communicating with the storage space 30S, and a body guide 31H (FIG. 4) which is an elongated-shaped protrusion.

The body flange 311 is a flange formed along a periphery of the top portion of the container body 31 defining the opening 31P. On the body flange 311, a lid flange 321 of the lid 32 is disposed in such a manner as to be mated therewith (FIG. 2). The body bearing portion 312 (FIG. 3) is formed in the left side portion 31L in such a manner as to be disposed to face the storage space 30S. The open cylindrical portion 313 is a cylindrical portion formed in the right side portion 31R, and internally has a shaft hole 313S penetrating therethrough to communicate between an outside of the container body 31 and the storage space 30S. The shaft hole 313S of the open cylindrical portion 313 is configured to allow an aftermentioned insertion portion 342B (FIG. 4) of the stirring paddle 34 and a engagement portion 363 (FIG. 3) of the input gear unit 36 to be inserted thereinto. As shown in FIG. 9, the open cylindrical portion 313 (shaft hole 313S) is disposed above a central region (approximately central region) of the right side portion 31R in the upward-downward direction, i.e., on the side of the opening 31P (FIG. 4) with respect the central region. Alternatively, in another embodiment, the open cylindrical portion 313 may be disposed in the central region of the right side portion 31R.

The first stud 316 (FIG. 9) is a columnar protrusion provided to protrude rightwardly from an upper end of a forward end region of the right side portion 31R. The first claw portion 314 is a plate-shaped protrusion provided just below the first stud 316 to protrude from a side edge of the right side portion 31R. The second stud 317 is a protrusion formed in a similar shape to that of the first stud 316 and disposed below the first claw portion 314. The second claw portion 315 is a protrusion formed in a similar shape to that of the first claw portion 314 and disposed in a lower end region of the right side portion 31R. The first stud 316 and the second stud 317 are configured to restrict a position of the cover 33 with respect to the container body 31. Further, each of the first claw portion 314 and the second claw portion 315 is constructed by employing a heretofore-known snap-fit structure, so as to fix the cover 33 to the right side portion 31R of the container body 31.

The lid 32 is fixed to the container body 31 in such a manner as to close the opening 31P. In this embodiment, the lid 32 is fixedly welded to the container body 31. The lid 32 includes a lid flange 321. The lid flange 321 is a flange formed along a periphery of the lid 32 in such a manner as to be mated with the body flange 311 of the container body 31. The lid 32 is fixed to the container body 31 by welding the lid flange 321 to the body flange 311 along the periphery of the opening 31P (FIG. 4).

The cover 33 is attached to the right side portion 31R of the container body 31. The cover 33 includes a cover guide 331 (FIGS. 2 and 11) and a cover support portion 332 (FIG. 11). The cover guide 331 is an elongated-shaped protrusion formed on a right side surface of the cover 33. Each of the cover guide 331 and the body guide 31H of the left side portion 31L is entered into a respective one of non-shown two guide grooves each formed inside the printer body 101 (FIG. 1) to guide a mounting of the toner container 30 into the printer body 101. The cover support portion 332 (FIG. 11) is a hollow cylinder-shaped protrusion formed on a left side surface of the cover 33. The cover support portion 332 is configured to support a cylindrical portion 36S (FIG. 11) of the input gear unit 36. The cover 33 also has a function of preventing the input gear unit 36 from being detached from the container body 31.

The stirring paddle 34 is disposed in the storage space 30S at a position above and away from the bottom portion 310 by a given distance (FIG. 3). The stirring paddle 34 is rotatably supported by the right side portion 31R and the left side portion 31L, and is operable to stir toner stored in the storage space 30S. The stirring paddle 34 is configured such that a length thereof in the longitudinal direction (rightward-leftward direction) is greater than a distance between the right side portion 31R and the left side portion 31L of the container body 31. The stirring paddle 34 is made of a resin material, and formed to be elastically deformable in such a manner as to bend along the longitudinal direction. The stirring paddle 34 (FIG. 4) includes a paddle shaft 340, a distal pivot portion 341 (FIG. 3), a coupling 342, and a paddle portion 343.

The paddle shaft 340 is made of an elastically-deformable resin material. The paddle shaft 340 is disposed to extend long in the rightward-leftward direction. The distal pivot portion 341 is disposed at a left end (the other one of longitudinally opposite ends) of the paddle shaft 340. The distal pivot portion 341 is pivotally supported by the body bearing portion 312 of the container body 31. The coupling 342 is disposed at a right end (one of the longitudinally opposite ends) of the paddle shaft 340. The coupling 342 has a hollow cylindrical shape.

The coupling 342 includes a coupling flange 342A (FIGS. 5 and 6) and an insertion portion 342B. The coupling flange 342A is a ring-shaped flange disposed around an outer periphery of the coupling 342. The insertion portion 342B corresponds to a portion of the coupling 342 located outside the coupling flange 342A in an axial direction (the rightward-leftward direction). The insertion portion 342B is configured to be insertable into the open cylindrical portion 313.

The paddle portion 343 is a film member fixed to the paddle shaft 340. The paddle portion 343 has an approximately rectangular shape, and is partially formed with a plurality of slits (FIG. 8). The paddle portion 343 is configured to be rotated together with the paddle shaft 340, thereby stirring toner stored in the storage space 30S. The paddle portion 343 includes a first protrusion 343A (FIGS. 4 and 8) and a second protrusion 343B (FIG. 8). The first protrusion 343A is a portion of the stirring paddle 34 partially protruding radially outwardly from a right end of the paddle portion 343. Similarly, the second protrusion 343B is a portion of the stirring paddle 34 partially protruding radially outwardly from a left end of the paddle portion 343. The first protrusion 343A has a rectangular shape, and the second protrusion 343B has a triangular shape. For the sake of explanation, in FIG. 8, each of the first protrusion 343A and the second protrusion 343B is shown such that it extends to the outside of the container body 31. However, actually, upon being rotated, the stirring paddle 34 including the first protrusion 343A and the second protrusion 343B is rubbed against an inner peripheral surface of the container body 31.

The conveyance screw 35 is a screw disposed along the bottom portion 310 of the container body 31. As shown in FIG. 8, a toner discharge port 31A is opened in the bottom portion 310 of the container body 31. The conveyance screw 35 is configured to be rotated to convey toner stored in the storage space 30S, toward the toner discharge port 31A. When a non-shown shutter provided on the container body 31 is slidingly moved, the toner discharge port 31A is opened to allow the toner to be discharged from the toner container 30.

The input gear unit 36 (FIG. 9) is a rotary gear unit which is disposed outside the container body 31 in opposed relation to the right side portion 31R of the container body 31. The input gear unit 36 has a two-stage gear configuration. Specifically, referring to FIG. 10, the input gear unit 36 includes a gear portion 361, a transmission portion 362, and an engagement portion 363. The gear portion 361 is a portion of the input gear unit 36 having a maximum diameter. An outer periphery of the gear portion 361 is formed with non-shown gear teeth. When the toner container 30 is mounted to the printer body 10, a non-shown drive mechanism is coupled to the gear portion 361. Thus makes it possible to input a rotational drive force from the drive mechanism into the toner container 30. The transmission portion 362 is disposed in axially adjacent relation to the gear portion 361. An outer periphery of the transmission portion 362 is also formed with non-shown gear teeth. The transmission portion 362 is meshingly engaged with the idler gear 37. The engagement portion 363 is disposed on a side opposite to the gear portion 361 with respect to the transmission portion 362. The engagement portion 363 extends from the transmission portion 362 toward the container body 31. The engagement portion 363 is configured such that a columnar outer peripheral surface thereof is partially cut out. The engagement portion 363 is engaged with the coupling 342 of the stirring paddle 34. In this state, the input gear unit 36 is operable to input the rotational drive force into the stirring paddle 34.

The input gear unit 36 further includes a cylindrical portion 36S (FIGS. 9 and 11). The cylindrical portion 36S is a portion of the input gear unit 36 formed on the side of a right end thereof to have a cylindrical shape. The cylindrical portion 36S of the input gear unit 36 is pivotally supported by the cover support portion 332 (FIG. 11) of the cover 33.

The idler gear 37 is a gear rotatably supported by the right side portion 31R at a position downward and rearward of the open cylindrical portion 313. The idler gear 37 is configured to transmit the rotational drive force from input gear unit 36 to the screw gear 38.

The screw gear 38 is a gear rotatably supported by the right side portion 31R at a position downward and rearward of the idler gear 37. The screw gear 38 is coupled to a right end of the conveyance screw 35. Thus, in conjunction with rotation of the input gear unit 36, the screw gear 38 is rotated in addition to the stirring paddle 34.

Next, assembling of the toner container 30 according to this embodiment will be described. Referring to FIGS. 4 and 5, first of all, the conveyance screw 35 is attached to the bottom portion of the container body 31 through the opening 31P of the container body 31. In this process, the right end of the conveyance screw 35 is inserted into a non-shown hole opened in the container body 31 in such a manner as to be exposed to the outside of the container body 31. Then, the screw gear 38 (FIG. 9) is attached to the exposed right end of the conveyance screw 35.

Subsequently, as shown in FIG. 5, the distal pivot portion 341 of the stirring paddle 34 is inserted into the body bearing portion 312 of the container body 31, and then a right end of the stirring paddle 34 is entered into the storage space 30S (FIG. 4). In this process, while the insertion portion 342B (FIG. 5) of the stirring paddle 34 is guided by an inclined sub-region 31G1 of a paddle guide region 31G formed in an inner wall surface of the right side portion 31R, the stirring paddle 34 is bent such that it is convexed downwardly in a circular arc shape along the longitudinal direction. Eventually, the coupling 342 of the stirring paddle 34 is inserted into the open cylindrical portion 313 (FIGS. 6 to 8)

As above, through operation of inserting the distal pivot portion 341 of the stirring paddle 34 into the body bearing portion 312 and then inserting the insertion portion 342B of the coupling 342 into the open cylindrical portion 313, the stirring paddle 34 is temporarily fixed within the storage space 30S (FIG. 7) at a position for allowing the engagement portion 363 of the input gear unit 36 to be inserted into a hollow space of the cylinder of the coupling 342. In this state, a support portion 313T (FIG. 11) composed of an inner peripheral surface of the open cylindrical portion 313 supports the insertion portion 342B of the coupling 342 from therebelow to thereby prevent the stirring paddle 34 from falling onto the bottom portion 310 of the container body 31.

In this embodiment, it is possible to weld the lid 32 to the container body 31 before attaching the input gear unit 36 to the container body 31. Specifically, in the state shown in FIGS. 6 to 8, the lid 32 is attached to the container body 31 from thereabove. In this process, the lid flange 321 (FIG. 2) of the lid 32 is disposed in such a manner as to be mated with the container body 311 of the container body 31. Then, the body flange 311 and the lid flange 321 are fixedly welded together while being temporarily fixed together by a non-shown welding jig. In this state, the input gear unit 36 is not yet attached around the right side portion 31R of the body flange 31. This makes it possible to dispose the welding jig in a region of the right side portion 31R adjacent to the body flange 311. Thus, even in a situation where the welding jig is disposed around the opening 31P during fixing of the lid 32, it is possible to prevent the welding operation from being hindered by the input gear unit 36.

Figure 12A:
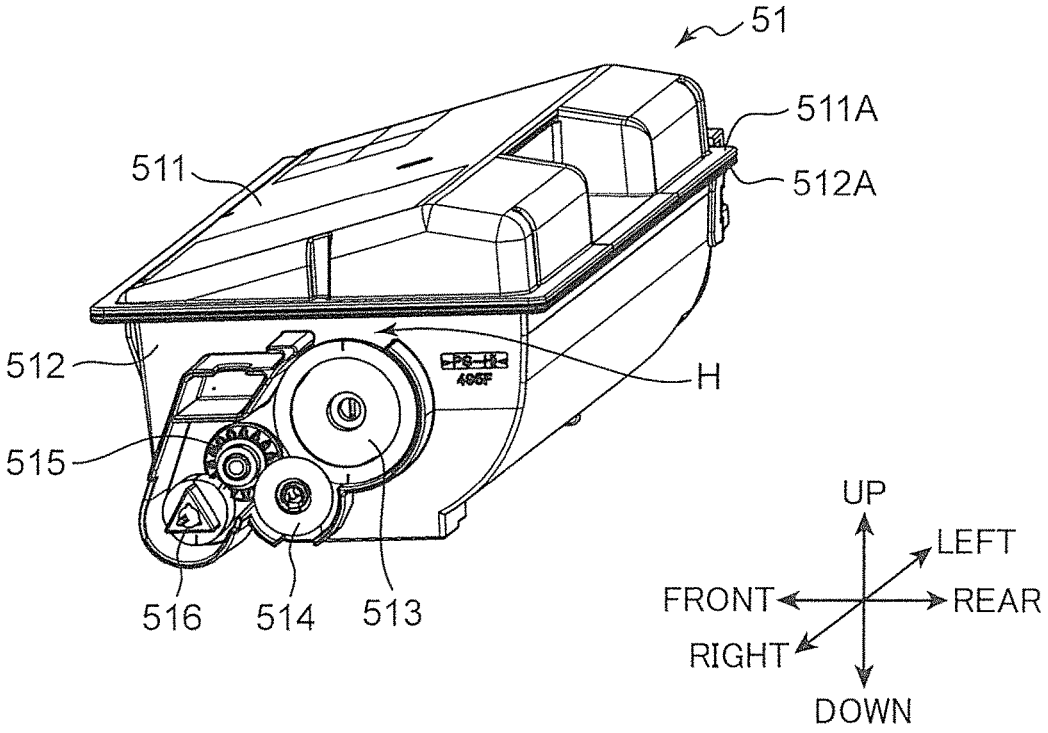
FIG. 12A is a perspective view showing a development storage container as one comparative example with respect to a development storage container according to an embodiment of the present invention.
Figure 12B:
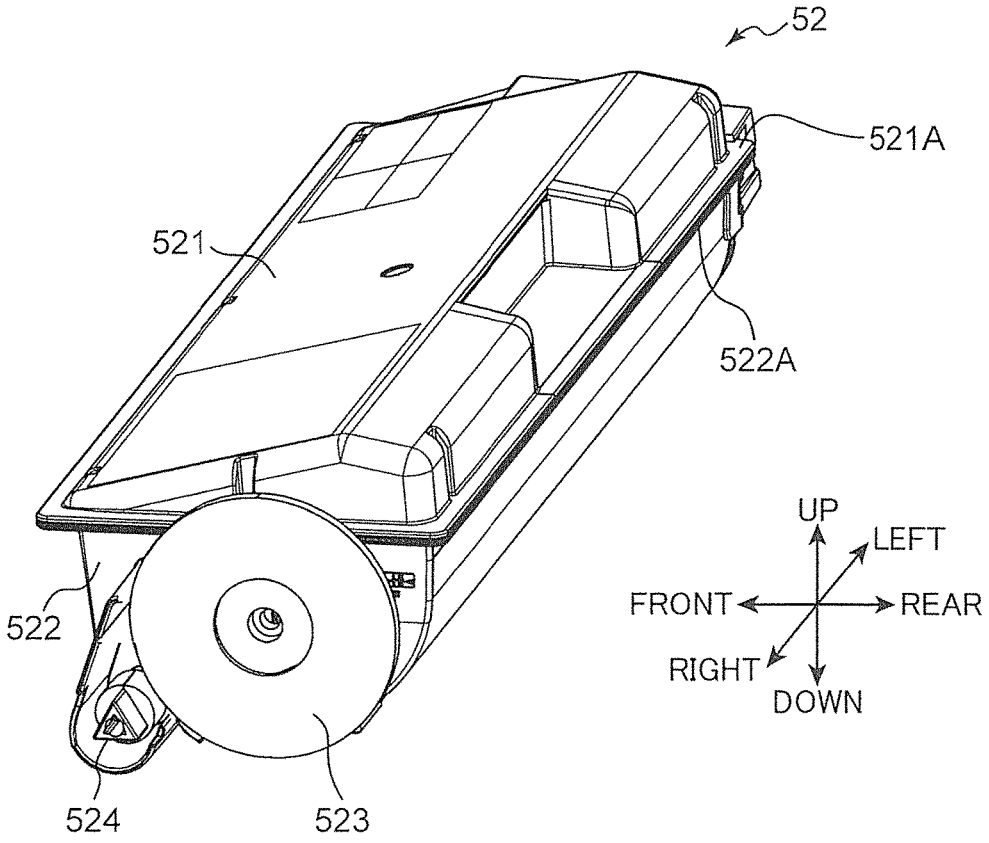
FIG. 12B is a perspective view showing a development storage container as another comparative example with respect to a development storage container according to an embodiment of the present invention.

FIGS. 12A and 12B are, respectively, perspective views showing other toner storage containers 51, 52 as comparative examples with respect to the toner container 30 according to this embodiment. In the toner container 51 shown in FIG. 12A a lid 511 is attached to a container body 512 from thereabove. A stirring member similar to the stirring paddle 34 in this embodiment is disposed inside the container body 512. However, this stirring member is devoid of the insertion portion 342B (FIG. 11). Therefore, it is impossible to temporarily fix the stirring member within the toner container 51. In this case, it is necessary to perform a welding operation of attaching, to the container body 512, a first gear 513 for transmitting a drive force to the stirring member, and then performing operation of welding the lid 511 to the container body 512.

For welding a body flange 512A of the container body 512 and a lid flange 511A of the lid 511 together, it is necessary to hold these flanges by a welding jig. For forming a gap H for the welding jig, just above the first gear 513, it is necessary to reduce an outer diameter of the first gear 513. This gives rise to a need to arrange a plurality of idler gears (a second gear 514 and a third gear 515) between the first gear 513 and a fourth gear 516 for transmitting a drive force to a screw similar to the conveyance screw 35 in this embodiment. As a result, there is a problem that the driving force transmission is excessively accelerated or decelerated before reaching the fourth gear 516, and an increase in the number of gears leads to an increase in cost of the toner container.

On the other hand, in the toner container 52 shown in FIG. 12B, a lid 521 is attached to a container body 522 from thereabove. A stirring member similar to the stirring paddle 34 in this embodiment is disposed inside the container body 522. However, this stirring member is also devoid of the insertion portion 342B (FIG. 11). Therefore, it is impossible to temporarily fix the stirring member within the toner container 52. In this case, it is necessary to attach integrally, to the container body 522, a fifth gear 523 for transmitting a drive force to the stirring member, and then performing operation of welding the lid 521 to the container body 522. In the toner container 52, the fifth gear 523 is directly meshed with a sixth gear 524 for transmitting a drive force to a screw similar to the conveyance screw 35 in this embodiment. However, the fifth gear 523 has a relatively large outer diameter, thereby making it possible to attach a welding jig therearound. Therefore, it is not easy to fixedly weld a lid flange 521A and a body flange 522A together on the side of a right end of the toner container 52. As above, the toner container configured to attaching the first gear 513 or the fifth gear 523 before welding the lid 511 or the lid 521 involves various problems.

In this embodiment, when the stirring paddle 34 is attached to the container body 31, the stirring paddle 34 is temporarily fixed at a position for allowing the engagement portion 363 of the input gear unit 36 to be inserted into the coupling 342, as mentioned above. Thus, as shown in FIGS. 9 and 10, after fixedly welding the lid 32 to the container body 31, the input gear unit 36 can be engaged with the coupling 342 attached to the container body 31. Further, the stirring paddle 34 disposed above the bottom portion 310 of the container body 31 is prevented from falling onto the bottom portion 310. Thus, there is no risk that an aggregate of toner is formed due to rubbing between the stirring paddle 34 and the bottom portion 310. In this embodiment, the coupling 342 of the stirring paddle 34 is disposed while being fitted in the open cylindrical portion 313. Thus, even when the input gear unit 36 is pulled away, the open cylindrical portion 313 and the cylindrical hollow space of the coupling 342 communicate with each other to inhibit external foreign substances from entering the storage space 30S.

Subsequently, when the engagement portion 363 of the input gear unit 36 is inserted into the cylindrical hollow space of (engaged with) the coupling 342, the input gear unit 36 and the stirring paddle 34 are integrated such that they are rotatable together. An O-ring 318 is disposed between the inner peripheral surface of the open cylindrical portion 313 and the engagement portion 363 of the input gear unit 36, in a compressed manner. This makes it possible to prevent toner filled inside the toner container 30 from leaking from the open cylindrical portion 313. Further, the input gear unit 36 is configured to be attachable and detachable with respect to the container body 31 in a state in which the lid 32 is fixed to the container body 31. Thus, even in a situation where some gear teeth of the gear portion 361 of the input gear unit 36 are broken, it is possible to easily replace the input gear unit 36 with a new one. Generally, in the case where the input gear unit 36 is configured to be slidable in the rightward-leftward direction, there is concern that the input gear unit 36 is detached during use of the toner container 30. In this embodiment, however, after attaching the input gear unit 36 to the container body 31, the cover 33 is attached to the container body 31 in such a manner as to cover at least a portion of the input gear unit 36. This makes it possible to prevent detachment of the input gear unit 36 from the container body 31. The cover 33 can be detached to easily realize replacement of the input gear unit 36. In addition, the cover 33 is configured such that the cover support portion 332 thereof can support the cylindrical portion 36S of the input gear unit 36 (FIG. 11). Thus, the cover 33 can also have a function of positioning an axis of the input gear unit 36. In a state in which the cover 33 is attached, toner is charged from the toner supplementing port 30T of the left side portion 31L into the storage space 30S. After charging of toner, a non-shown cap is inserted into the toner supplementing port 30T to sealingly close the toner supplementing port 30T.

As mentioned above, in the above embodiment, the stirring paddle 34 is temporarily fixed within the storage space 30S, so that it is possible to easily couple the input gear unit 36 to the stirring paddle 34. Thus, even after fixing the lid 32 to the container body 31, the input gear unit 36 can be attached to the container body 31. In other words, it becomes possible to prevent a situation where operation of fixing the lid 32 to the container body 31 is hindered by the input gear unit 36.

In the above embodiment, the stirring paddle 34 can be temporarily fixed to the container body 31 easily through the operation of bending the stirring paddle 34. It is also possible to reduce a need to dispose an additional coupling member between the stirring paddle 34 and each of the body bearing portion 312 and the open cylindrical portion 313. Further, even when the stirring paddle 34 has a length greater than a distance between the right side portion 31R and the left side portion 31L it is possible to easily attach the stirring paddle 34 to the container body 31 without a need to divide the stirring paddle 34 along the axial direction into a plurality of pieces.

Although the present invention had been described based on the toner container 30 according to one embodiment thereof and the printer 100 equipped with the toner container 30, the present invention is not limited thereto, but various modifications and changed may be made therein, for example, as follows.

(1) Although the above embodiment has been described based on an example where the toner container 30 includes the cover 33, the present invention is not limited thereto. That is, the toner container 30 may be devoid of the cover 33. In this case, the toner container 30 preferably includes another member for preventing detachment of the input gear unit 36.

(2) Although the above embodiment has been described based on an example where the container body 31 has the paddle guide region 31G, the present invention is not limited thereto. Even when the container body 31 is devoid of the paddle guide region 31G, the stirring paddle 34 can be easily attached to the container body 31 while being elastically deformed.

The invention claimed is:

1. A developer storage container comprising:

a container body including a bottom portion, an opening extending in a longitudinal direction thereof, a first sidewall and a second sidewall arranged, respectively, at longitudinally opposite ends thereof, and a storage space disposed between the first sidewall and the second sidewall to store developer therein;

a lid fixed to the container body in such a manner as to close the opening;

a stirring member which stirs the developer stored in the storage space, the stirring member being disposed in the storage space at a position above and away from the bottom portion by a given distance, and rotatably supported by the first sidewall and the second sidewall; and an input gear unit which inputs a rotational drive force into the stirring member, the input gear unit being disposed outside the first sidewall of the container body, and including an engagement portion engageable with the stirring member, wherein:

the stirring member includes a coupling disposed at one of longitudinally opposite ends thereof and engageable with the engagement portion of the input gear unit in the storage space, and a distal pivot portion disposed at the other one of the longitudinally opposite ends, the coupling having a hollow cylindrical shape allowing the engagement portion of the input gear unit to be inserted therein, a coupling flange having a ring-shape and disposed around an outer periphery of the coupling, and an insertion portion having a hollow cylindrical shape and located farther out in an axial direction than the coupling flange;

the second sidewall includes a bearing portion disposed to face the storage space;

the first sidewall includes an open cylinder portion projecting from the first side wall toward the outside in the longitudinal direction and internally having a shaft hole that communicates between an outside of the container body and the storage space, a support portion that is a specified portion of an inner peripheral surface of the open cylindrical portion, the support portion supporting the insertion portion of the coupling from therebelow to fix the stirring member temporarily within the storage space at a position for allowing the engagement portion of the input gear to be inserted into a hollow space of the cylinder of the coupling and to prevent the stirring member from falling onto the bottom portion when the distal pivot portion is inserted into the bearing portion, and the insertion portion of the coupling is inserted into the shaft hole of the open cylindrical portion, and a guide region formed in an inner wall surface of the first side wall above the shaft hole;

the stirring member is elastically deformable in such a manner as to bend along the longitudinal direction, the stirring member being set such that a length thereof in the longitudinal direction is greater than a distance between the first sidewall and the second sidewall; and the guide region includes an inclined sub-region that guides the insertion portion of the stirring member so that the insertion portion of the stirring member is inserted into the open cylindrical portion after the distal pivot portion of the stirring member is inserted into the bearing portion.

2. The developer storage container according to claim 1, wherein the input gear unit is engageable with the coupling of the stirring member supported by the support portion, after the lid is fixed to the container body.

3. The developer storage container according to claim 2, wherein:

the lid is fixedly welded to the container body along a peripheral edge of the opening; and the shaft hole is disposed in an approximately central region of the first sidewall or on the side of the opening with respect a central region of the first sidewall.

4. The developer storage container according to claim 1, further comprising an O-ring which is compressed between the inner peripheral wall of the open cylindrical portion and the input gear unit with the engagement portion being engaged with the coupling.

5. The developer storage container according to claim 1, wherein the input gear unit has a structure for enabling attachment and detachment thereof with respect to the container body in a state in which the lid is fixed to the container body, and the developer storage container further comprises a cover capable of being attached to the container body to cover a portion of the input gear unit attached to the container body, to thereby prevent detachment of the input gear, the input gear unit further includes an input gear cylindrical portion that has a hollow cylindrical shape, and the cover includes a cover support portion that supports the input gear cylindrical portion so that the cover positions an axis of the input gear unit.

6. An image forming apparatus comprising:

the developer storage container according to claim 1;

an image supporting body having a surface on which an electrostatic latent image is to be formed and a developer image being supported on the surface; and a transfer unit which transfers the developer image from the image supporting body to a sheet.

* * * * *